US006889885B2

(12) United States Patent
Ohmori

(10) Patent No.: US 6,889,885 B2
(45) Date of Patent: May 10, 2005

(54) COMBUSTION-POWERED NAIL GUN

(75) Inventor: Yasuki Ohmori, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/636,773

(22) Filed: Aug. 8, 2003

(65) Prior Publication Data

US 2004/0026475 A1 Feb. 12, 2004

(30) Foreign Application Priority Data

Aug. 9, 2002 (JP) ..... P2002-233389

(51) Int. Cl.[7] ..... B25C 1/04
(52) U.S. Cl. ..... 227/10; 227/8; 227/130
(58) Field of Search ..... 227/8, 10, 130

(56) References Cited

U.S. PATENT DOCUMENTS 4,377,991 A * 3/1983 Liesse ..... 123/46 SC
4,403,722 A 9/1983 Nikolich
4,483,280 A 11/1984 Nikolich
4,483,473 A 11/1984 Wagdy
4,483,474 A 11/1984 Nikolich et al.
RE32,452 E 7/1987 Nikolich
5,197,646 A * 3/1993 Nikolich ..... 227/8
5,732,870 A * 3/1998 Moorman et al. ..... 227/130
2004/0026476 A1 * 2/2004 Shima et al. ..... 227/10

FOREIGN PATENT DOCUMENTS

DE 199 62 711 A1 7/2001
EP 0 913 234 A2 5/1999

* cited by examiner

*Primary Examiner*—Rinaldi I. Rada
*Assistant Examiner*—Tranh Truong
(74) *Attorney, Agent, or Firm*—Sughrue Mion, PLLC

(57) ABSTRACT

A combustion-powered nail gun including an arrangement for promoting a piston returning motion to its upper dead center. A combustion chamber frame is movable toward and away from a head cover at which a spark plug is provided. When the combustion chamber frame is in close contact with the head cover, a combustion chamber is provided among the combustion chamber frame, the head cover, a part of a cylinder and a piston. After the piston reaches the lower dead center as a result of combustion, a thermal vacuum is provided in the combustion chamber for allowing the piston to move toward the upper dead center. The combustion chamber frame has a through-hole, and a valve is provided for normally closing the through-hole. A solenoid is provided to selectively open the valve for leaking an increased pressure in the combustion chamber through the through-hole during the return stroke of the piston.

6 Claims, 7 Drawing Sheets

COMBUSTION-POWERED NAIL GUN

BACKGROUND OF THE INVENTION

The present invention relates to a combustion-powered nail gun that generates drive force by igniting a fuel/air mixture to drive a fastener such as a nail into a work piece.

U.S. Pat. No. 4,403,722, 4,483,280 (U.S. Re. Pat. No. 32,452), U.S. Pat. Nos. 4,483,473, and 4,483,474 disclose combustion-powered tool assemblies. FIG. 8 schematically shows configuration of a conventional combustion-powered nail gun 100 similar to that disclosed in these U.S. Patents. The nail gun 100 includes a housing 114 to which a handle 111, a tail cover 117, a push lever 121, and a magazine 113 are disposed.

The housing 114 accommodates therein a head cover 123, a combustion chamber frame 115, a cylinder 104, and a piston 110. The combustion chamber frame 115, the head cover 123, and the piston 110 together define a combustion chamber 105. Further, the piston 110 divides the internal space of the cylinder 104 and the combustion chamber frame 115 into upper chamber S2 inclusive of the combustion chamber 105 and a lower chamber S1. The head cover 123 and the cylinder 104 are fixed to the housing 114. The combustion chamber frame 115 is vertically movable within the housing 114 as guided by the housing 114 and the cylinder 104. The upper end of the combustion chamber 115 can be seated on the head cover 123 to provide the sealed combustion chamber 105. Although not shown in the drawings, a connection rod linkingly connects the combustion chamber frame 115 with the push lever 121 so that the combustion chamber frame 115 and the push lever 121 move together in an interlocking relation to each other.

Further, a spring (not shown) is provided for urging the push lever 121 downward. Therefore, the push lever 121 and the combustion chamber frame 115 are urged downwardly while no force operates against the urging force of the spring. At this time, because the head cover 123 and the cylinder 104 are fixed, an inlet (not shown) is opened between the head cover 123 and a top end of the combustion chamber frame 115, and an outlet (not shown) is opened between the upper outer peripheral portion of the cylinder 104 and the combustion chamber frame 115. Although not shown in the drawings, annular seals for forming tight seals at the inlet and the outlet are provided at the lower end of the head cover 123 and the upper end of the cylinder 104. Further, an intake vent (not shown) is provided in the upper end of the housing 114, and a discharge vent (not shown) is provided in the lower end of the housing 114.

The housing 114 further accommodates a motor (not shown), a spark plug 109 in a space above the head cover 123. Further, a fuel canister 107 holding a fuel is disposed in the housing 114. An injection port (not shown) connects the fuel canister 107 for supplying combustible gas from the fuel canister 107 into the combustion chamber 105. A fan 106 is disposed in the combustion chamber 105. The fan 106 is attached to and rotated by the drive shaft of the motor (not shown). Electrodes of the spark plug 109 are exposed to the combustion chamber 105. Ribs 124 are provided on the inner surface of the combustion chamber frame 115 so as to protrude radially inwardly of the combustion chamber 105.

A seal ring (not shown) is held at an outer peripheral surface of the piston 110 so as to be slidably movable with respect to the cylinder 104. A bumper (not shown) is provided in the cylinder 104 and below the piston 110 for absorbing excessive energy of the piston 110 after a nail driving operation. Also, an exhaust hole (not shown) is formed in the cylinder 104. A check valve (not shown) of well-known construction is provided on the outer side of the exhaust hole. A driver blade 116 extends from the piston 110 toward the tail cover 117 for driving a nail. A trigger spring 112A is connected the trigger switch 112 for biasing the trigger switch 112 toward its OFF position.

The handle 111 is attached to a middle section of the housing 114. A trigger switch 112 is provided on the handle 111. The trigger switch 112 is biased by a trigger switch spring 112A for urging the trigger switch 112 toward its OFF position. Each time the trigger switch 112 is pulled (turned ON), the spark plug 109 generates a spark if the sealed combustion chamber 105 is provided.

The magazine 113 and the tail cover 117 are attached to the lower end of the housing 114. The magazine 113 is filled with nails (not shown). The magazine 113 feeds the nails one at a time to the tail cover 117. The tail cover 117 sets the nails fed from the magazine 113 in a position below the driver blade 116 and guides movement of the nails when the nails are driven downward by the driver blade 116 into a workpiece W.

A mechanism 200 for maintaining closing state of the combustion chamber 105 is provided. The mechanism 200 includes a trigger switch bracket 201 extending from the trigger switch 112, a rod 202 extending from the combustion chamber frame 115, and a cam member 203. The trigger switch bracket 201 has a lower end provided with a pivot pin 205. The cam member 203 has a slot opening 206 engaged with the pivot pin 205. The cam 203 is pivotally connected to the housing 114 by a pivot bush 207, and has a first stop surface 208 selectively engageable with a lower end of the rod 202. Further, the cam 203 has a second stop surface 209 for preventing manipulation of the trigger switch 112.

When the combustion chamber frame 115 is separated from the head cover 123 by the biasing force of the spring, the rod 202 is positioned beside the second stop surface 209, so that counterclockwise pivotal movement of the cam 203 is prevented, thereby preventing upward movement of the trigger switch 112. When the combustion chamber frame 115 is seated onto the head cover 123, the rod 202 is moved away from the second stop surface 209, so as to allow counterclockwise movement of the cam 203. In this state, if the trigger switch 112 is pulled upwardly (turned ON) against the biasing force of the trigger switch spring 112A, the cam 203 is pivotally moved in the counterclockwise direction, so that the lower end of the rod 202 can be seated on the first stop surface 208. As a result, downward movement of the combustion chamber frame 115 is prevented by the abutment between the rod 202 and the first stop surface 208.

If the tool 100 is moved away from the workpiece W and if the trigger switch 112 is released, the cam 203 can be piviotally moved in a clockwise direction by the biasing force of the trigger switch spring 112A, so that the lower end of the rod 202 slides over the first stop surface 208, and can be positioned beside the second stop surface 209.

In the conventional combustion-powered nail gun, the piston 110 is moved to its lower dead center as a result of combustion, and the piston 110 is returned to its original upper dead center by the pressure difference between the upper chamber S2 and the lower chamber S1. After the combustion, negative pressure is generated in the upper chamber S2 because high pressure combustion gas is discharged through the exhaust hole and the check valve and because heat of the combustion chamber 105 is gradually absorbed into the cylinder 104 and the combustion chamber frame 115 to lower the internal pressure. This is generally referred to as "thermal vacuum". On the other hand, atmospheric pressure is applied in the lower chamber S1. Thus, the piston 110 can be moved toward its upper dead center.

However, the internal pressure of upper chamber S2 is increased in accordance with the movement of piston 110 toward its upper dead center, if the cooling speed cannot provide the pressure decrease in the upper chamber S2. Accordingly, the moving speed of the piston 110 toward its upper dead center is lowered or greatly varied dependent on cooling speed (pressure reducing speed) of the upper chamber S2. Consequently, one shot cycle requires a prolonged period, and an operator may be fatigued from such driving work. This is particularly disadvantageous in case of a repeating shot type nail gun in which a trigger switch 112 is maintained in its ON position while successively driving a plurality of nails at different locations of the workpiece W by repeatedly pushing and releasing the push lever 121 toward and away from the workpiece W.

SUMMARY OF THE INVENTION

It is therefore, an object of the present invention to provide a combustion-powered nail gun capable of providing a rapid piston returning speed toward its upper dead center thereby enhancing nail driving efficiency and reducing physical fatigue of a worker.

This and other objects of the present invention will be attained by a combustion-powered tool for driving a fastener into a workpiece including a housing, a push lever, a head cover, a cylinder, a piston, a combustion chamber frame, a driver blade, a spark plug, a check valve, a magazine, a tail cover, and a shut-off mechanism. The push lever is supported at a lower end of the housing. The head cover is disposed at an upper portion of the housing. The cylinder is fixedly disposed in the housing and is formed with an exhaust hole. The piston is slidably movably disposed in the cylinder and divides the cylinder into an upper chamber and a lower chamber. The piston is movable toward its lower dead center and its upper dead center. The combustion chamber frame is disposed within the housing and is movable in interlocking relation to the movement of the push lever to bring into contact with and out of contact from the head cover for selectively defining a combustion chamber in combination with the head cover and the piston. The combustion chamber frame is formed with a through hole at a position defining a part of the combustion chamber. The driver blade extends from the piston in the lower chamber. The spark plug is exposed to the combustion chamber for igniting a fuel/air mixture provided in the combustion chamber. A check valve is disposed at the exhaust hole for normally closing the exhaust hole. The magazine is disposed at the lower end of the housing for accumulating therein a plurality of fasteners. The tail cover is disposed at the lower end of the housing and is positioned below the driver blade. Each fastener is fed into the tail cover from the magazine. The shut-off mechanism is provided at an outer side of the combustion chamber frame for closing an outlet end of the through hole during an initial fastener driving operation but opening the through hole only when an inner pressure of the upper chamber exceeds a predetermined pressure during the movement of the piston toward the upper dead center.

DETAILED DESCRIPTION OF THE PREFERRED EMBODIMENTS

A combustion-powered nail guns according to one embodiment of the present invention will be described with reference to FIGS. 1 through 6.

Figure 8:
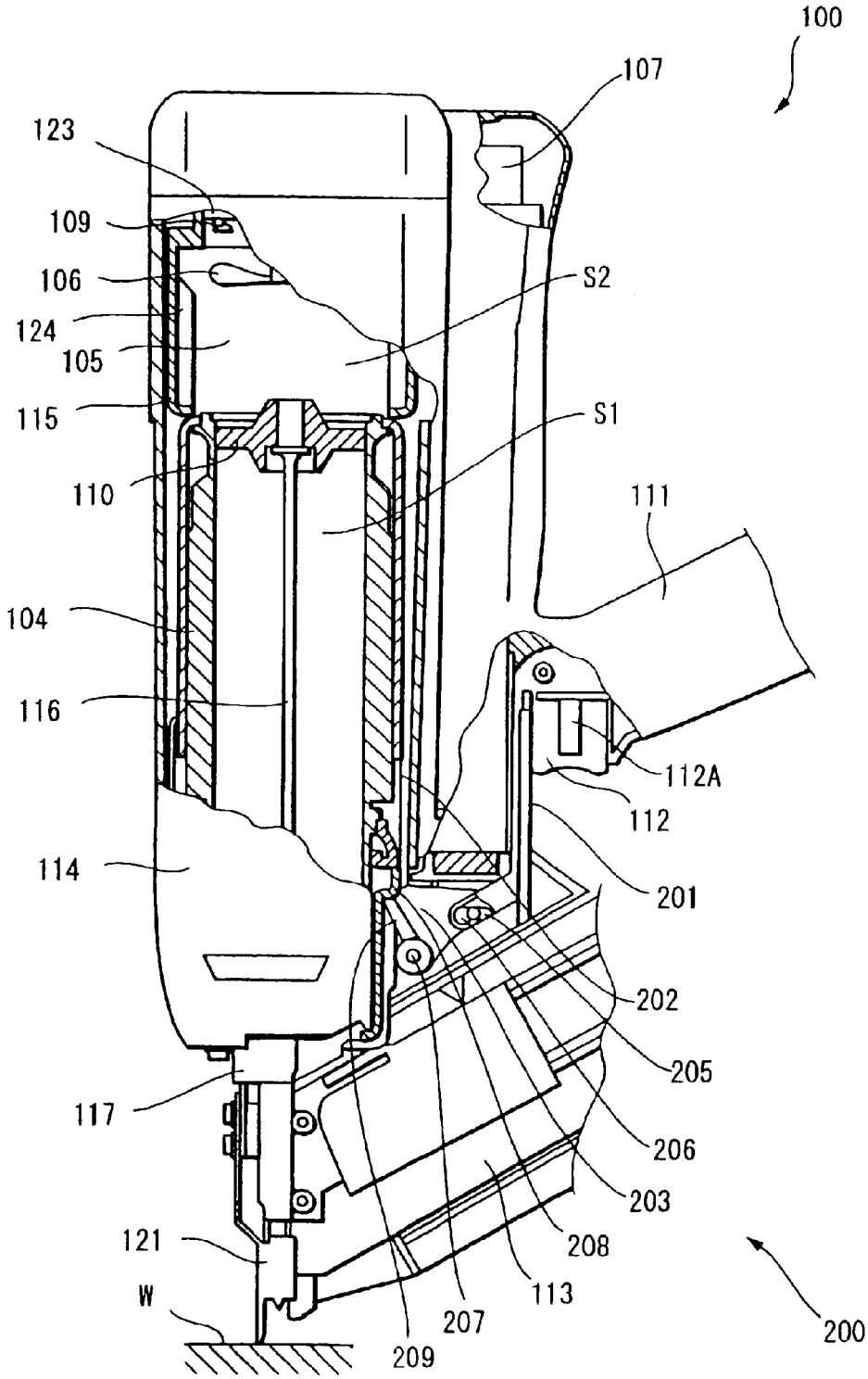
FIG. 8 PRIOR ART
FIG. 8 is a partial cross-sectional view showing the conventional combustion-powered nail gun in a condition after a push lever is pressed against a workpiece.

A structure of a combustion powered nail gun 1 is almost the same as that of the conventional nail gun 100 shown in FIG. 8, The nail gun 1 includes a housing 14, a head cover 23, a combustion chamber frame 15, ribs 24, a cylinder 4, a piston 10, a driver blade 16, a handle 11, a trigger switch 12, a magazine 13, a tail cover 17, a push lever 21, a fan 6, a motor 8, a spark plug 9, and fuel canister 7 those similar to those of the conventional nail gun 100 shown in FIG. 8. The combustion chamber frame 15, the head cover 23, and the piston 10 together define a combustion chamber 5. Further, the piston 10 divides the cylinder 4 into a lower chamber S1 and an upper chamber S2 inclusive of the combustion chamber 5. The combustion chamber frame 15 is connected to the push lever 21 through a connection rod (not shown) for providing interlocking movement therebetween. Incidentally, atmospheric pressure is applied to the lower chamber S1.

Figure 1:
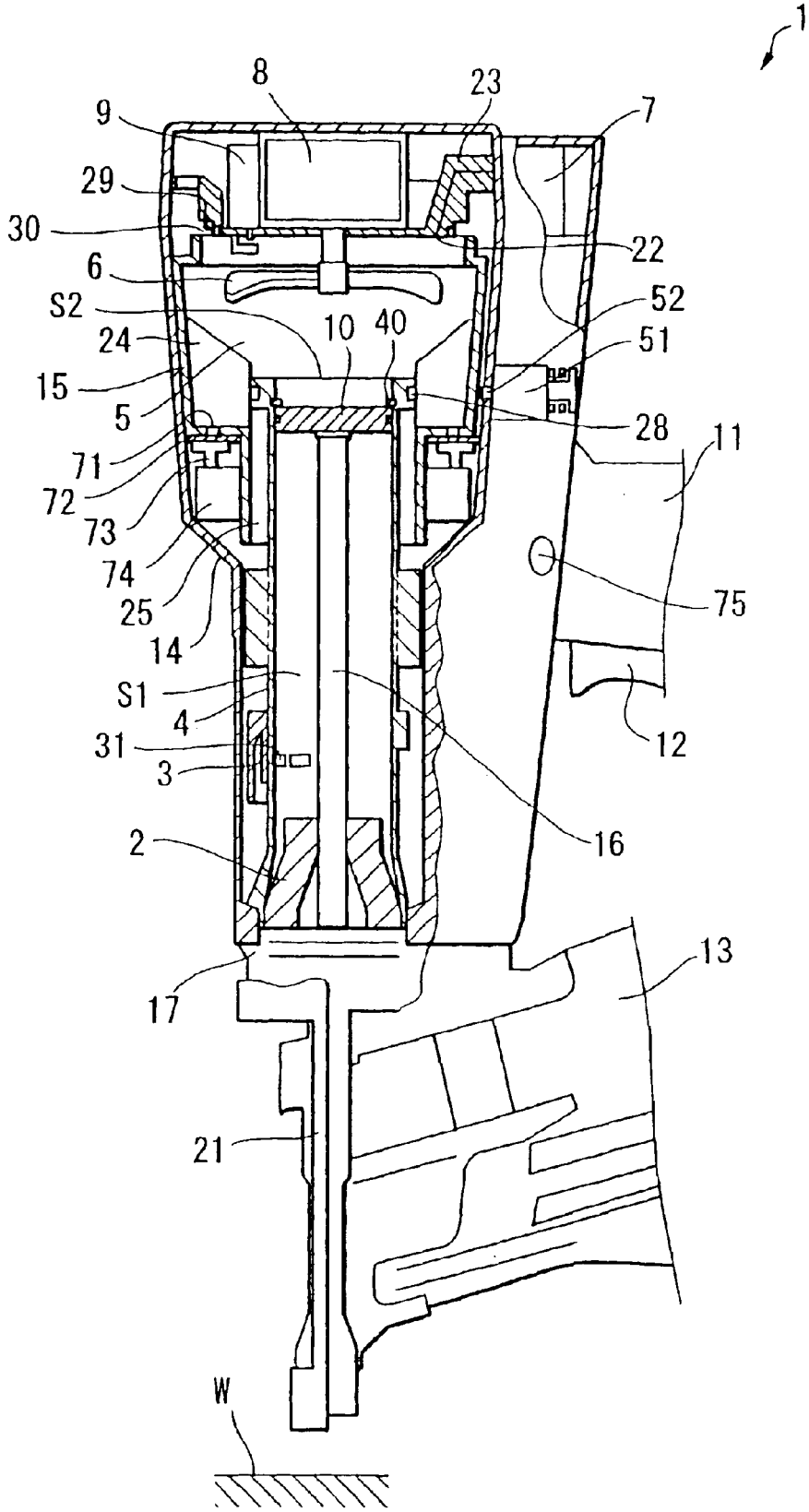
FIG. 1 is a partial cross-sectional view showing a combustion-powered nail gun in an initial condition before a nail driving operation is performed according to one embodiment of the present invention.

A spring (not shown) is provided for urging the push lever 21 downward. Therefore, the push lever 21 and the combustion chamber frame 15 are urged downwardly while no force operates against the urging force of the spring as shown in FIG. 1. In this state, an inlet passage 30 is provided between the head cover 23 and the upper end portion of the combustion chamber frame 15, and an outlet passage 25 is provided between the cylinder 4 and the lower portion of the combustion chamber frame 15.

An annular seal member 29 is disposed at the head cover 23 which can be in sealing contact with the upper part of the combustion chamber frame 15 for closing the inlet passage 30 when the push lever 21 is pressed against a workpiece W. Further, an annular seal member 28 is disposed at an upper outer peripheral portion of the cylinder 4 which can be in sealing contact with the lower part of the combustion chamber frame 15 for closing the outlet passage 25 when the push lever 21 is pressed against the workpiece W. Further, an intake vent (not shown) is provided in the upper end of the housing 14 and a discharge vent (not shown) is provided in the lower end of the housing 14.

An injection port 22 is open to the combustion chamber 5 and is fluidly connected to the canister 7. A seal ring 10A is held at an outer peripheral surface of the piston 10 so as to be slidably movable with respect to the cylinder 4. In the cylinder 4, a bumper 2 is provided below the piston 10 for absorbing excessive energy of the piston 10 after a nail driving operation. Also, exhaust holes 3 are formed in the cylinder 4, and check valves 31 is provided on the outer side of the exhaust holes 3. Further, a stop ring 40 is implanted in an upper inner peripheral surface of the cylinder 4 so that the piston 10 is abuttable against the stop ring 40 for preventing the piston 10 from its excessive movement during its return stroke. At the housing 14, a display 75 such as a LED is visibly provided for displaying driving state or drivable state of the nail gun 1.

A solenoid 51 is fixed to the outer surface of the housing 14. The solenoid 51 has a plunger 52 movable toward and away from the combustion chamber frame 15 and engageable with and releasable from the combustion chamber frame 15. The solenoid 51 is adapted for preventing the combustion chamber frame 15 from moving away from the head cover 23 so as to maintain thermal vacuum in the upper space S2.

Figure 2:
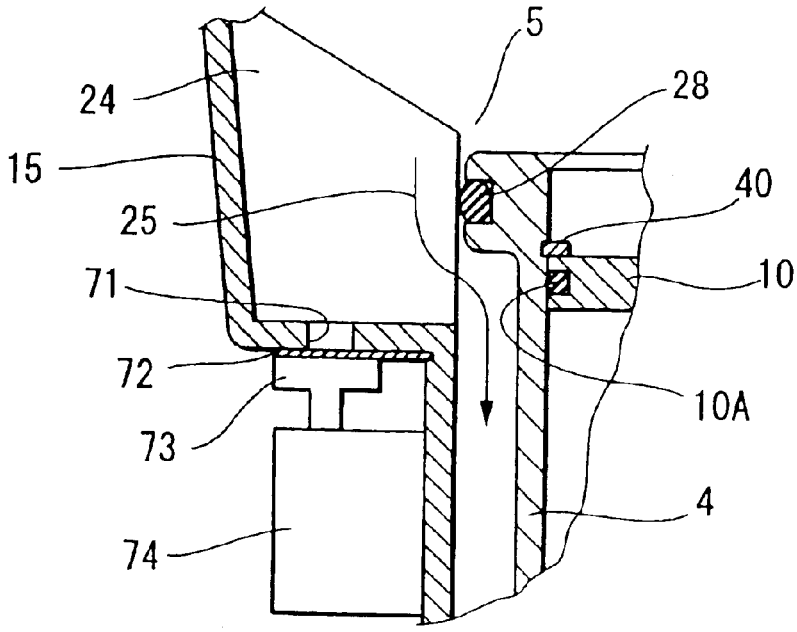
FIG. 2 is an enlarged cross-sectional view showing an essential portion of the initial condition according to the embodiment.
Figure 3:
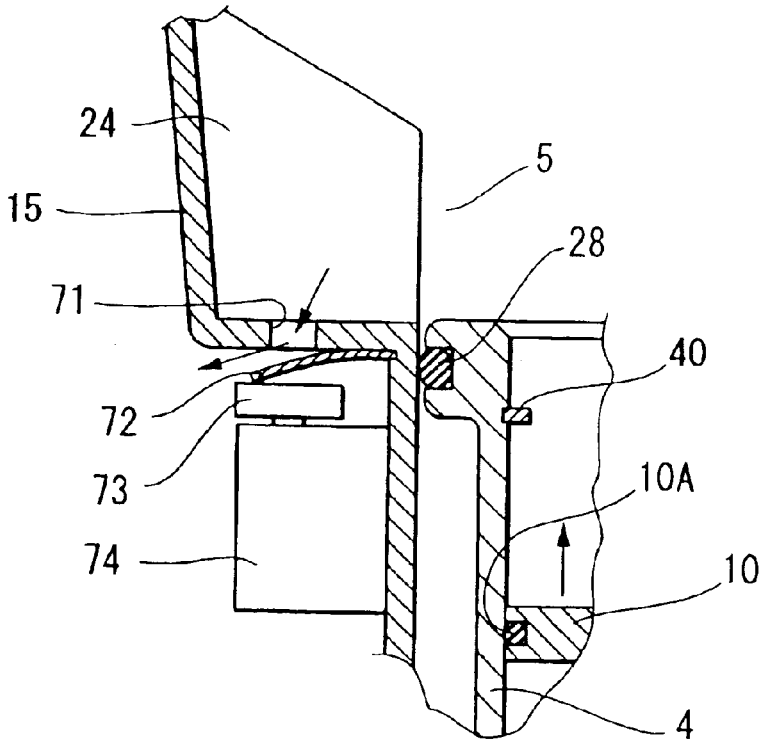
FIG. 3 is an enlarged cross-sectional view showing the essential portion in a state where a combustion chamber frame has been moved to its upper sealed position while a combustion chamber is partially communicated with an outside.

A head switch 80 (FIG. 4) is provided within the housing 4 for detecting a timing at which the combustion chamber frame 15 reaches its upper stroke end position after the push lever 21 is pressed against the workpiece W for moving the push lever 21 toward the head cover 23. As shown in FIGS. 2 and 3, the combustion chamber frame 15 is formed with a through hole 71, and a check valve 72 is pivotally movably attached to the combustion chamber frame 15 so as to selectively close the through hole 71. A solenoid 74 is fixed to the outer surface of the combustion chamber frame 15. The solenoid 74 has a plunger 73 and a plunger spring (not shown) biasing the plunger 73 toward its protruding position as shown in FIG. 2. The plunger 73 maintains protruding position by the biasing force of the plunger spring upon deenergization of the solenoid 74 for closing the through hole 71 by the check valve 72, whereupon fluid communication between the inside and outside of the space S2 through the through hole 71 is prevented. The plunger 73 can be retracted as shown in FIG. 3 upon energization of the solenoid 74 so as to nullify the biasing force of the plunger spring for releasing the check valve 72 from the plunger 73 so that the through hole 71 can be opened whereupon the fluid communication through the through hole 71 can be provided.

Figure 4:
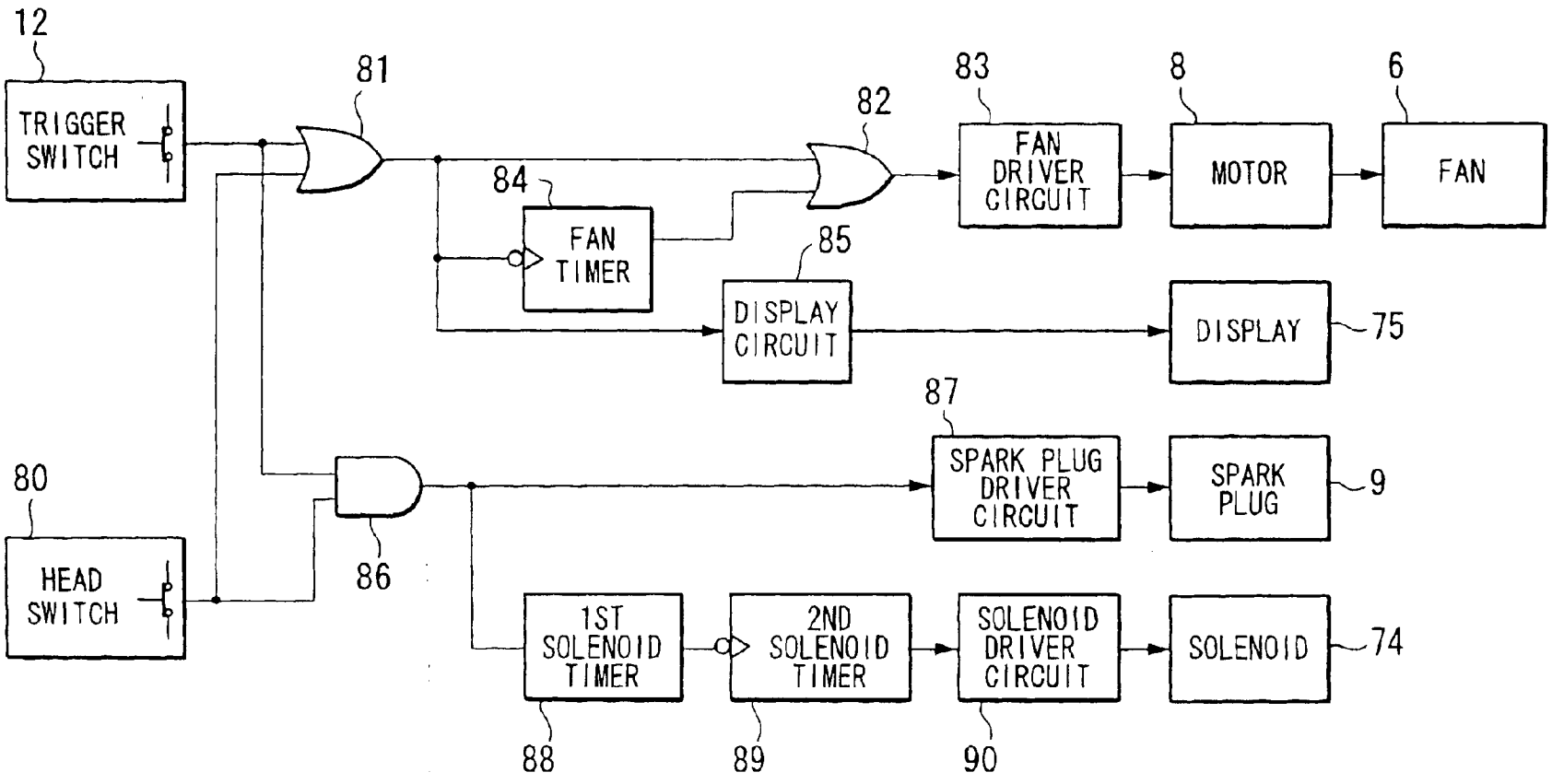
FIG. 4 is a block diagram showing an electrical circuit in the embodiment.
Figure 5:
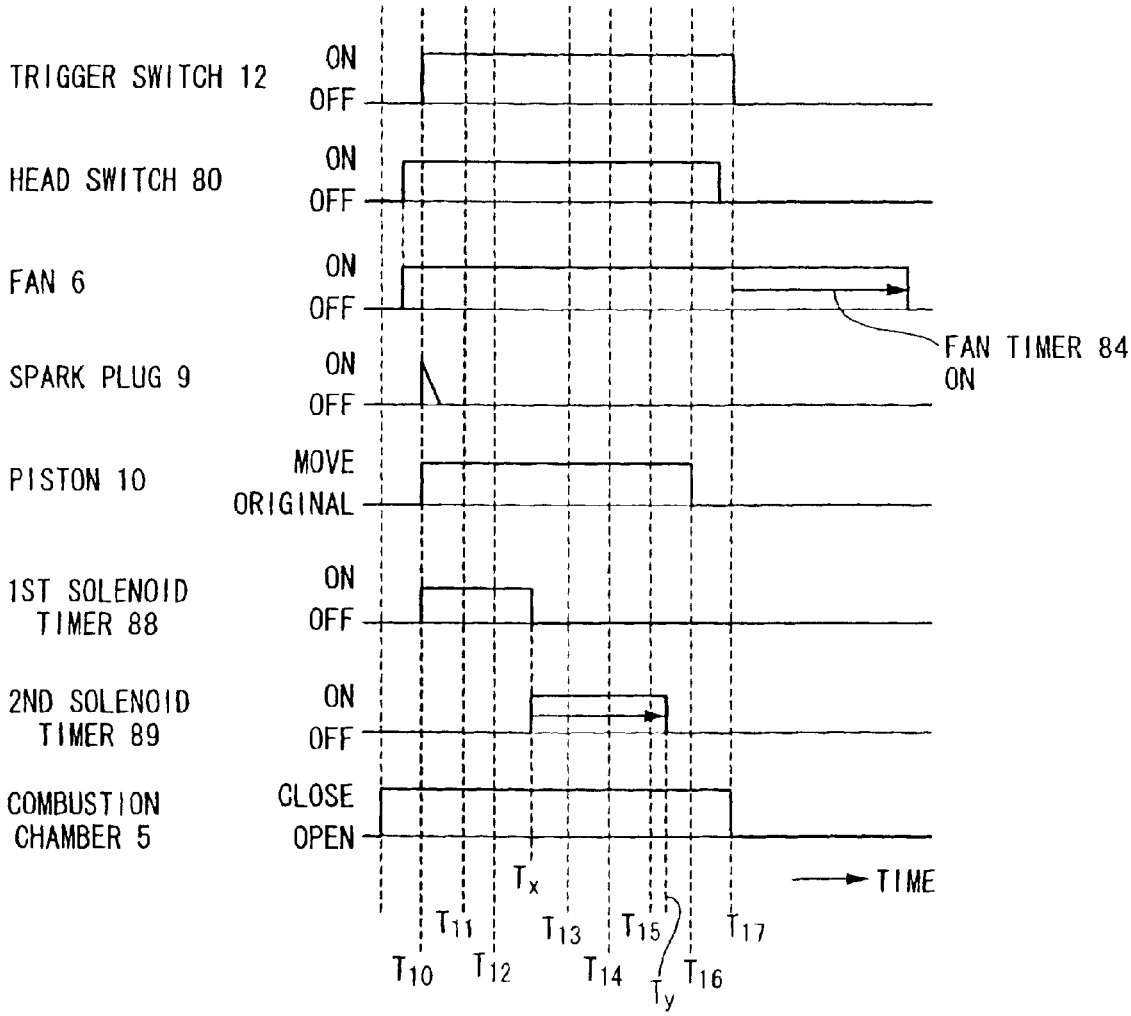
FIG. 5 is a timing chart showing operations of various components in the embodiment.

FIG. 4 shows an electrical circuit equipped with the nail gun 1. The trigger switch 12 and the head switch 80 are connected to a first OR gate 81 that is connected to a second OR gate 82. A fan driver circuit 83 connected to the motor 8 is connected to the second OR gate 82. Therefore, the rotation of the fan 8 can be started upon turning ON at least one of the trigger switch 12 and the head switch 80.

A fan timer 84 is connected between an output terminal of the first OR gate 81 and an input terminal of the second OR gate 82. The fan timer 84 is turned ON when both the trigger switch 12 and the head switch 80 are OFF states (T17 in FIG. 5). The rotation of the fan 8 is stopped after elapse of predetermined time period from the ON timing of the fan timer 84. A display circuit 85 is connected to the output terminal of the first OR gate 81, and the display 75 is connected to the display circuit 85. The display circuit 85 is turned ON when at least one of the trigger switch 12 and the head switch 80 are turned ON.

An AND gate 86 is connected to the trigger switch 12 and the head switch 80, and a spark plug driver circuit 87 is connected to the AND gate 86. The spark plug 9 is connected to the spark plug driver circuit 87. Therefore, the spark plug 9 ignites when both the head switch 80 and the trigger switch 12 are turned ON.

A first solenoid timer 88 is connected to an output terminal of the AND gate 86. The first solenoid timer 88 is turned ON when both the head switch 80 and the trigger switch 12 are turned ON, and is turned OFF after elapse of a predetermined time period (from T10 to Tx in FIG. 5). A second solenoid timer 89 is connected to the first solenoid timer 88. The second solenoid timer 89 is turned ON upon turning OFF the first solenoid timer 88, and is turned OFF after elapse of a predetermined time period (from Tx to Ty in FIG. 5). The solenoid 74 is connected to the solenoid driver circuit 90. The solenoid 74 is energized during ON state of the second solenoid timer 89.

Next, operation of the nail gun 1 will be described. FIG. 1 shows the combustion-powered nail gun 1 with the combustion chamber frame 15 in the lowermost condition before a nail driving operation is performed. At this time, the push lever 21 is urged downward by the spring (not shown). The combustion chamber frame 15 is also in its lowermost position so that the inlet 30 is open between the combustion chamber frame 15 and the head cover 23 and the outlet 25 is open between the combustion chamber frame 15 and the cylinder 4. Also, the piston 10 is in its top dead position before a nail driving operation starts.

To prepare to drive a nail into a work piece W, the user grips the handle 11 and presses the push lever 21 against the workpiece W. As a result the push lever 21 rises upward against the urging force of the spring and the combustion chamber frame 15 connected to the push lever 21 moves upward. When the combustion chamber frame 15 moves upward in this manner, the inlet 30 and the outlet 25 close up to seal close the combustion chamber 5 with the seal rings 29 and 28. Further, the head switch 80 detects the combustion chamber frame 15 to start rotation of the fan 6.

As a result of upward travel of the combustion chamber frame 15, the fuel canister 7 is pressed and supplies combustible gas to the injection port 22, which injects the combustible gas into the combustion chamber 5. The injected combustible gas and air in the combustion chamber 5 are agitated and mixed together by rotation of the fan 6 in the sealed off combustion chamber 5 and influence of the ribs 24 that protrude into the combustion chamber 5.

Next, the user pulls the trigger switch 12 on the handle 11 to generate a spark at the spark plug 9. The spark ignites and explodes the fuel/air mixture in the combustion chamber 5. The combustion, explosion and expansion of the air/fuel mixture drives the piston 10 and the driver blade 16 downward to drive the nail that is set in the tail cover 17 into the workpiece W.

During movement of the piston 10 toward its lower dead center, the piston 10 moves past the exhaust hole 3 so that the combustion gas in the upper space S2 is discharged outside of the cylinder 4 through the exhaust hole 3 and the check valve 31 until the pressure in the upper space S2 reaches atmospheric pressure, whereupon the check valve 31 in the exhaust hole 3 closes shut. Finally, the piston 10 strikes against the bumper 2 whereupon the piston 10 bounds as a result of impingement onto the bumper 2 (see T11 in FIG. 6).

During this period, the inner surface of the cylinder 4 and the inner surface of the combustion chamber frame 15 absorb heat of the combusted gas so that the combusted gas rapidly cools and contracts. Therefore, after the check valve 31 closes, pressure in the upper chamber S2 decreases to below atmospheric pressure. This is referred to as a thermal vacuum. This thermal vacuum pulls the piston 10 back to the upper dead position because of the pressure difference between the upper chamber S2 and the lower chamber S1. The plunger 52 of the solenoid 51 maintains pull out position to engage the combustion chamber frame 15 for maintaining the combustion chamber frame 15 in its sealed position so as to maintain thermal vacuum in the upper chamber S2 until the piston 10 returns to its original upper til the piston 10 returns to its original upper dead center.

After the nail is driven into the work piece W, the user releases the trigger switch 12 and lifts the nail gun 1 upward away from the workpiece W. When the push lever 21 separates from the workpiece W, the spring (not shown) urges the push lever 21 and the combustion chamber frame 15 back into the positions shown in FIG. 1. Even after the trigger switch 12 is released and turned off, the fan 6 maintains rotation for a fixed period of time to scavenge the combusted gas in the combustion chamber 5. That is, in the condition shown in FIG. 1, the inlet 30 and the outlet 25 are opened up above and below the combustion chamber frame 15 respectively. The combusted gas in the combustion chamber 5 is scavenged by rotation of the fan 6, which generates an air flow that draws clean air in through the intake vent (not shown) and that exhausts combusted gas from the discharge vent (not shown). After the scavenging operation, the fan 6 is stopped.

Figure 6:
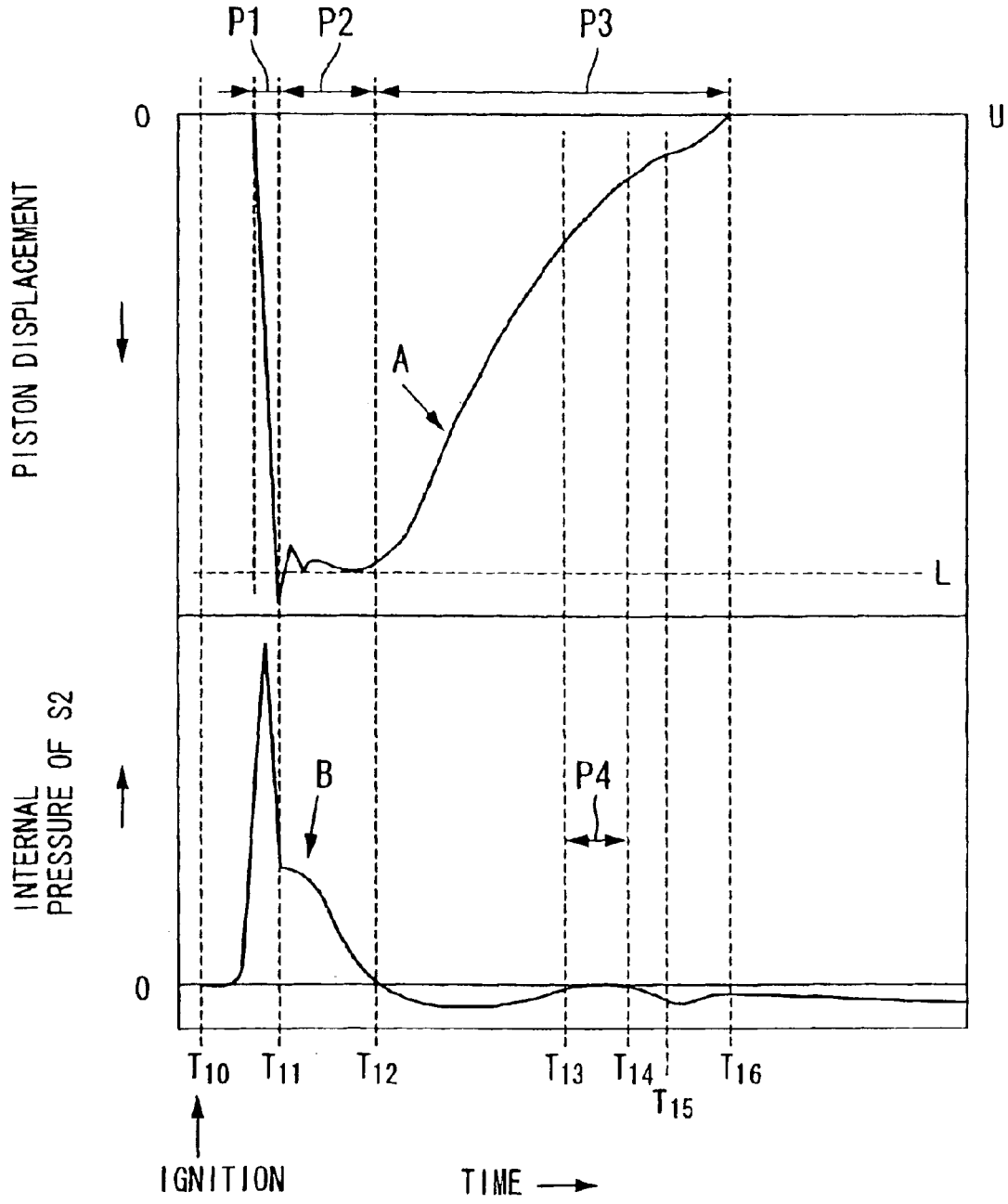
FIG. 6 is a graphical representation showing a change in piston displacement and a change in internal pressure of an upper space S2 with time according to the embodiment.

Operation of the solenoid 74 will be described with reference to FIGS. 2 through 6. In FIG. 6, "U" designates upper dead center of the piston 10, "L" designates the lower dead center of the piston 10, "P1" designates the one-way stroke of the piston 10 toward the lower dead center, "P2" designates a period where the piston 10 locates at or near the lower dead center, "P3" designates return stroke of the piston 10, and "P4" designates the pressure releasing period by the check valve 72. Further, a curve "A" designates displacement of the piston 10, and a curve "B" designates inner pressure of the upper chamber S2.

During the return stroke of the piston 10, the solenoid 74 is energized from the timing Tx to Ty for nullifying biasing force of the plunger spring (not shown), so that the the plunger 75 becomes retractable, and the check valve 72 becomes movable. As shown in FIG. 6, since negative pressure is provided in the upper chamber S2 from the period T12 to T13, the check valve 72 is urged to its closing position by the negative pressure regardless of the non-urging by the plunger 73.

If the piston 10 further moves toward its upper dead center, the internal pressure of the upper chamber S2 is gradually increased due to reduction in volume of the upper chamber S2, and the internal pressure of the upper chamber S2 is reaching to the atmospheric pressure at the timing T13. However, in this instance, since the check valve 72 is not urged by the plunger 73, the check valve 72 can be opened to provide fluid communication between the upper chamber S2 and the outside through the through hole 71 as shown in FIG. 3. Thus, the increased pressure is leaked through the through hole 71. As a result, the inner pressure of the upper chamber S2 does not exceed the atmospheric pressure (gauge pressure) from the timing T13 to T14. Because of the above described internal pressure variation in the upper chamber S2, the piston 10 maintains movement to the upper dead center without any temporary retard or stop as shown in FIG. 6. Consequently, entire piston return stroke can be performed with a reduced period.

The solenoid 74 is deenergized at the timing Ty so as to move the plunger 75 to its protruding position as shown in FIG. 2. Thus, the upper space S2 is completely sealed to promote thermal vacuum after the timing T14. As a result, the piston 10 is urged to be moved to its upper dead center.

Figure 7:
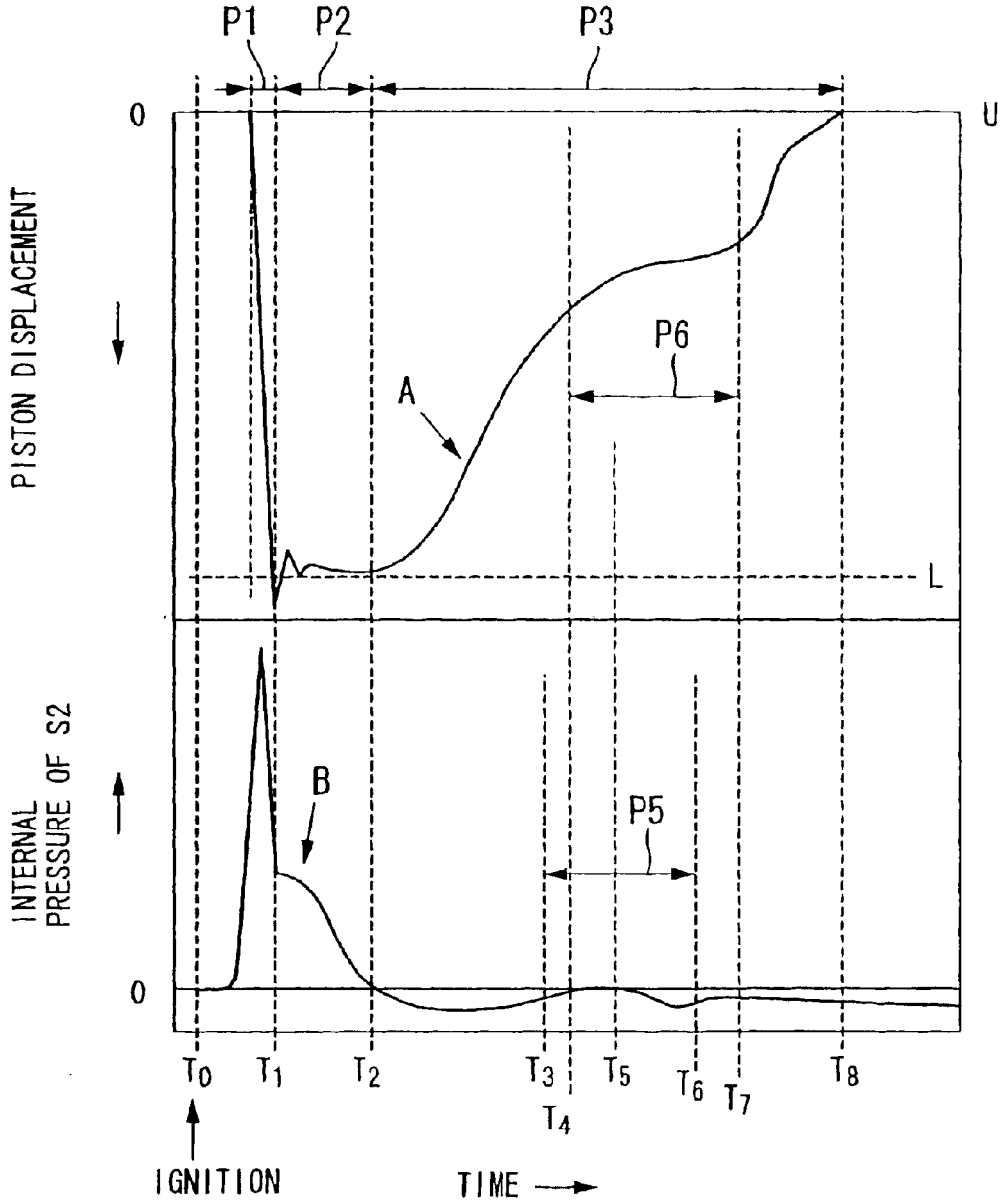
FIG. 7 is a graphical representation showing a change in piston displacement and a change in internal pressure of an upper space S2 with time according to a conventional combustion powered nail gun shown in FIG. 8.

FIG. 7 shows a comparative data with respect to the conventional nail gun 100 shown in FIG. 8. According to FIG. 7, the piston 110 bounds at the timing T1 due to abutment of 15 the piston 110 with the bumper similar to the timing T11 in FIG. 6. Then, the piston 110 remains at its lower dead position from the timing T1 to T2 similar to the timing from T11 to T12 of FIG. 6 until thermal vacuum is established in the upper chamber S2. When the upper chamber S2 has a negative pressure, the piston 110 moves toward the upper dead center at the timing T2 similar to the timing T12 of FIG. 6. However, in the region P5 from the timing T3 to T6 (corresponding to the timing from T13 to T16 in FIG. 6), positive pressure is established in the upper chamber S2 because the inner volume of the upper chamber S2 is compressed by the upward movement of the piston 110 and cooling speed cannot provide the pressure decrease in the upper chamber S2, and mainly because components corresponding to the solenoid 74, the plunger 73 and the check valve 72 are not provided and the combustion chamber frame 115 is not formed with the through hole 71. Therefore, the displacement speed of the piston 110 is decelerated from the timing T4 to T7 as shown in a region P6.

After the timing T6, negative pressure is again provided in the upper chamber S2 as a result of cooling, so that the movement of the piston 110 toward the upper dead center can be accelerated, and the piston 110 reaches the upper dead center at the timing T8. In the present embodiment, the piston 10 reaches its upper dead center at the timing T16 (corresponding to the timing T6 in FIG. 7). Thus, it is apparent that the nail gun according to the embodiment of the present invention provides a shot cycle with a reduced period in comparison with the conventional nail gun 100. This is particularly advantageous in case of repeating shots.

While the invention has been described in detail with reference to the specific embodiments thereof, it would be apparent to those skilled in the art that various changes and modifications may be made therein without departing from the spirit of the invention.

For example, in the depicted embodiment, the protruding state and retracting state of the plunger 73 is provided upon deenergization and energization of the solenoid 74, respectively. This is advantageous in terms of energy saving as long as the closing period of the check valve 72 is longer than the opening period thereof. However, protruding state and retracting state of the plunger 73 can be provided upon energization and deenergization of the solenoid, respectively. Further, the mechanism 200 for maintaining closing state of the combustion chamber as shown in FIG. 8 can be incorporated in the above-described embodiment instead of the solenoid 51 and the plunger 52.

What is claimed is:

1. A combustion-powered tool for driving a fastener into a workpiece, comprising:

a housing having an upper portion and a lower end;

a push lever supported at the lower end of the housing;

a head cover disposed at the upper portion of the housing;

a cylinder fixedly disposed in the housing and formed with an exhaust hole;

a piston slidably movably disposed in the cylinder and dividing the cylinder into an upper chamber and a lower chamber, the piston being movable toward its lower dead center and its upper dead center;

a combustion chamber frame disposed within the housing and movable in interlocking relation to the movement of the push lever to bring into contact with and out of contact from the head cover for selectively defining a combustion chamber in combination with the head cover and the piston, the combustion chamber frame being formed with a through hole at a position defining a part of the combustion chamber;

a driver blade extending from the piston in the lower chamber;

a spark plug exposed to the combustion chamber for igniting a fuel/air mixture provided in the combustion chamber;

a check valve disposed at the exhaust hole for normally closing the exhaust hole;

a magazine disposed at the lower end of the housing for accumulating therein a plurality of fasteners;

a tail cover disposed at the lower end of the housing and positioned below the driver blade, each fastener being fed into the tail cover from the magazine; and a shut-off mechanism provided at an outer side of the combustion chamber frame for closing an outlet end of the through hole during an initial fastener driving operation but opening the through hole only when an inner pressure of the upper chamber exceeds a predetermined pressure during the movement of the piston toward the upper dead center.

2. The combustion-powered tool as claimed in claim 1, wherein the shut-off mechanism comprises:

a valve member having one end attached to the combustion chamber frame and having a free end movable toward and away from the outlet end; and a solenoid having a plunger movable toward the valve member for fixing a close position of the valve member, and movable away from the valve member for releasing the valve member.

3. The combustion-powered tool as claimed in claim 2, further comprising:

a trigger switch provided to the housing; and a head switch provided in the housing for detecting a predetermined position of the combustion chamber frame, a spark being generated from the spark plug upon manipulation of the trigger switch only when the predetermined position is detected by the head switch.

4. The combustion-powered tool as claimed in claim 3, further comprising a control unit for controlling an actuation timing of the solenoid, the unit comprising:

a first solenoid timer energized upon manipulation of the trigger switch and upon detection of the predetermined position by the head switch, the first solenoid timer being deenergized after elapse of a first predetermined period from the energization timing;

a second solenoid timer energized upon deenergization of the first solenoid timer, the second solenoid timer being deenergized after elapse of a second predetermined period from its energization; and a solenoid driver circuit connected to the solenoid, the solenoid driver circuit driving the solenoid during energization of the second solenoid timer.

5. The combustion-powered tool as claimed in claim 1, further comprising:

a motor disposed at the head cover; and a fan rotatably disposed in the combustion chamber and driven by the motor.

6. The combustion-powered tool as claimed in claim 1, further comprising:

a first seal member providing a first seal between the combustion chamber frame and the head cover when the combustion chamber frame is brought into contact with the head cover; and a second seal member providing a second seal between the combustion chamber frame and the cylinder when the combustion chamber frame is brought into contact with the head cover.

* * * * *